United States Patent [19]

Sippel et al.

[11] 4,202,668

[45] May 13, 1980

[54] GELLED FUEL SIMULANT

[75] Inventors: Nathan J. Sippel, Ridgecrest; Earl J. Hiser, China Lake; John Christy, Ridgecrest, all of Calif.

[73] Assignee: The United States of America as represented by the Secretary of the Navy, Washington, D.C.

[21] Appl. No.: 64,153

[22] Filed: Jul. 15, 1970

[51] Int. Cl.[2] ..... C10L 7/00

[52] U.S. Cl. ..... 44/7 A; 44/68; 149/87

[58] Field of Search ..... 252/19, 26, 315, 316, 252/317; 44/7 A, 7 E, 68; 264/3; 149/87

[56] References Cited

U.S. PATENT DOCUMENTS

| | | | |
|---|---|---|---|
| 2,618,596 | 11/1952 | Minich et al. | 44/7 A X |
| 2,684,339 | 7/1954 | Herron | 44/7 A X |
| 3,243,326 | 3/1966 | White et al. | 149/87 X |
| 3,539,310 | 11/1970 | Finkelstein et al. | 44/7 A |

*Primary Examiner*—Leland A. Sebastian
*Attorney, Agent, or Firm*—R. S. Sciascia; W. Thom Skeer; M. Beistline

[57] ABSTRACT

A relatively stable inert simulant formulation for a hazardous metallized fuel which has the density, shear rate and yield stress of the duplicated fuel. This formulation provides inexpensive and safe testing of exploratory hydraulic studies, or testing of the mechanical strength of containers, plumbing, etc., in which the metallized fuels are to be used.

2 Claims, No Drawings

GELLED FUEL SIMULANT

GOVERNMENT INTEREST

The invention described herein may be manufactured and used by or for the Government of the United States of America for governmental purposes without the payment of any royalties thereon or therefor.

BACKGROUND OF THE INVENTION

The present invention is for an inert simulant composition for a metallized gelled fuel.

Metallized gelled fuels have been used in improved propellant systems for some time. They provide a monopropellant for reaction motors which has the advantages of both liquid and solid propellants. Inert simulants or duplications thereof having the necessary characteristics for their practical use in mock rocket motors and similar components are not known. Vibration and storage studies are made of the metallized gelled fuels and the use of an inert simulant provides a safe means of establishing certain mechanical characteristics necessary for the motor or container to be ultimately used for the gelled fuel. The present invention provides a comparatively safe and effective inert material.

DESCRIPTION OF THE INVENTION

In accordance with the present invention a simulant formulation for metallized gelled fuels of the type used in rocket propulsion was prepared. The formulation comprises napalm powder, silicon dioxide, kerosene, and powdered aluminum mixed in proportions to simulate the metallized gelled fuel consisting of hydrazine, monomethylhydrazine, unsymmetrical dimethylhydrazine and mixtures thereof, silicon dioxide and hydroxyethylcellulose. The simulant formulation had the following physical properties possessed by the gelled fuel: viscosity: 150 centipoises at shear rate of $10^4$ $sec^{-1}$ at 77° F.; density of about 1.5 g/cc; ability to keep 60 weight percent aluminum powder in suspension, and ability for the gelled slurry to flow at −65° F. and to demonstrate gel stability at +65° F.

The following are examples of the simulant formulations prepared which demonstrate the invention:

EXAMPLE I

| Ingredients | Percent by weight |
|---|---|
| M2 Napalm powder | 3.0 |
| Silicon dioxide | 2.0 |
| Kerosene | 35.0 |
| Aluminum (5μ) | 60.0 |

To make a 10-gallon batch of the above, 3.64 pounds of napalm was slowly mixed into 42.45 pounds of kerosene to form a partial gel. A mixture of 2.43 pounds of Cab-O-Sil (silicon dioxide) and 72.77 pounds of 5 micron, spherical aluminum powder was slowly poured into the partially gelled kerosene to form a metallized inert gel. The gel was mixed in a 15-gallon steel drum using a mechanical stirrer, alternately mixing at low, high, and medium shear rate. The total mixing time was 4½ hours.

Napalm comprises an aluminum soap consisting essentially of oleic, naphthenic, and coconut oil fatty acids. It becomes viscous when shaken and makes gasoline or kerosene thicken or gel. The silicon dioxide makes it possible to suspend at least 60% of the aluminum powder with less than 2% settling. Although napalm gels the kerosene, its ability to suspend metal powders has not been good. The present inert formulation had the following physical properties which simulate the gelled fuel as shown in the table below. At −65° F. the simulant flows through a 10 cc syringe orifice of 0.048" diameter.

TABLE

Comparison of Physical Properties

| Physical properties | Inert simulant | Metallized gelled fuel |
|---|---|---|
| at 77° F. | | |
| Density | 1.407 gms/cc | 1.545 gms/cc |
| Viscosity, poises, at shear rate of $sec^{-1}$ of | | |
| $10^4$ | 4.3 | 1.5 |
| $5(10)^3$ | 5.6 | 2.2 |
| $2.5(10)^3$ | 10.4 | 3.6 |
| $(10)^3$ | 21.5 | 7.0 |
| at −65° F. | | |
| Density | 1.464 | 1.619 |
| Viscosity, poises, at shear rate of $sec^{-1}$ of | | |
| $2(10)^3$ | 46.3 | 24.5 |
| $(10)^3$ | 62.0 | 30.0 |
| $0.5(10)^3$ | 92.0 | 42.0 |
| $0.5(10)^3$ | 165.0 | 72.5 |
| Yield stress at 25° C. | 1,126 dynes/cm | 1,100 dynes/$cm^2$ |

EXAMPLE II

| Ingredients | Percent by weight |
|---|---|
| M4 Napalm powder | 0.4 |
| Kerosene | 38.6 |
| Aluminum (5M) | 60.0 |
| Silicon dioxide | 1.0 |

The above ingredients were mixed by the same procedure set out in Example I. The physical properties were comparable to those of the metallized gel formulation herein disclosed.

The stability of the inert simulant formulation has been demonstrated. Four months after preparation, ten gallons were vibrated in the vertical, transverse, and longitudinal directions. Total vibration time was 3 hours per axis at ambient temperature. Cured samples were taken through the horizontal length of the tank and analyzed for density, and total solids content. Density and total solids agreed within 2%.

After one year no additional settling of aluminum powder was noted. Settling was determined by density measurements using gamma ray transmission. Readings were considered accurate within ±1%. There was no liquid separation.

The following carrier liquids have been satisfactorily gelled in addition to kerosene, JP-4, JP-5, aviation gasoline, regular gasoline, white gasoline, benzene and toluene.

The physical characteristics of the relatively inert gelled simulant are sufficiently similar to the gelled fuel to use it as a substitute for hazardous testing. It can be used as an incendiary and with formulation modifications in rocket or ramjet operations. Other metal powders can be suspended such as magnesium, boron, boron carbide, zirconium, and tungsten.

What is claimed is:

1. An inert simulant formulation for metallized gelled fuel composition comprising an admixture of about 30 to 40 percent by weight hydrocarbon fuel selected from the group consisting of kerosene, aviation gasoline, white gasoline, toluene, and benzene, about 60% by weight aluminum powder, about 1–2% by weight silicon dioxide, and from 0.4 to 5% by weight napalm powder to simulate a density of from about 1.4 to 1.5 grams/cc, a viscosity of about 150 centipoises at shear rate of $10^4$ $sec^{-1}$ at 77° F. and ability to flow at −65° F.

2. The formulation in accordance with claim 1 wherein the fuel consists of from 35 to 40 percent by weight kerosene.

* * * * *